US005335804A

United States Patent [19]

Flory

[11] Patent Number: 5,335,804

[45] Date of Patent: Aug. 9, 1994

[54] CANISTER

[76] Inventor: Vera A. Flory, 104 Yost Rd., West Alexandria, Ohio 45381

[21] Appl. No.: 101,842

[22] Filed: Aug. 4, 1993

Related U.S. Application Data

[63] Continuation of Ser. No. 810,897, Dec. 20, 1991, abandoned.

[51] Int. Cl.[5] ..... A47F 5/00

[52] U.S. Cl. ..... 211/78; 312/238; D7/614

[58] Field of Search ..... 211/77, 78, 144; 312/238, 305; D6/437, 562, 570, 573, 574; D7/612, 614, 615; 220/23.83

[56] References Cited

U.S. PATENT DOCUMENTS

| | | | |
|---|---|---|---|
| D. 99,608 | 5/1936 | Schurlock | D7/614 |
| D. 183,755 | 10/1958 | Lax | D7/612 |
| D. 185,736 | 7/1959 | Cole | D7/612 |
| D. 208,806 | 10/1967 | Bliss | D7/614 |
| D. 280,965 | 10/1985 | Prophet et al. | D7/614 |
| 1,978,695 | 10/1934 | Clark | 211/77 |
| 2,074,564 | 3/1937 | Schurlock | 211/77 |
| 3,127,994 | 4/1964 | Campbell | 211/144 |
| 4,418,970 | 12/1983 | Hyder et al. | 312/238 X |
| 4,483,455 | 11/1984 | Prophet et al. | D7/614 X |

*Primary Examiner*—Robert W. Gibson, Jr.

[57] ABSTRACT

A canister for the circular shelves of kitchen corner cabinets are made of a shape to fit by being wider on the end which fits next to the circumference, than the opposing end, being joined between by two sides of equal length, with upstanding side walls perpendicular to the base, and with a substantially closing lid member. The depth of canister from front to back being determined, in part, by the radius of the shelves for which it is made and, in part, by the size of the center object and the like. The volume being determined by the width and the height of the canister.

20 Claims, 4 Drawing Sheets

CANISTER

RELATED APPLICATION

This application is a continuation of application Ser. No. 07/810,897, dated Dec. 20, 1991 now abandoned.

BACKGROUND OF INVENTION

1. Field of the Invention

This invention relates to a canister for the kitchen and in particular to a canister for the circular rotating shelves of kitchen corner cabinets.

2. Background

Heretofore, canisters of round, square or rectangular nature leave lots of unused space on the shelves of lazy susan cabinets. This space could be utilized a little better if sizes and shapes were mixed, but then it would look very messy and some canisters would be hard to get access to.

The U.S. Pat. Nos. 4,483,455, D208965 and D208966 to Prophet, Wolf and Simmons show a "Food Storage Container System" that claim "a plurality of sector-shaped containers positioned in said compartments". These canisters are too narrow where they meet in the center to be of much use in utilizing space and being uniform and neat where there is a center post, brackets, and/or raised places. Because of the center object and the like, the present invention is not sector-shaped, and will be described in later description.

The Ambasz U.S. Pat. No. D314139 shows a "Container" that seems a hard container to fill to be of much use in the present invention.

The Sirotkin U.S. Pat. No. 4,572,374 shows a container, but the two sides that appear to be the same length would need to be much longer to utilize the space on the shelves for the present invention.

SUMMARY OF THE INVENTION

The principal object of the invention is to provide a canister that will fit on the circular rotating shelves of kitchen corner cabinets, along with others of similar shape to utilize more of the space and to provide uniformity and neatness on the shelves so the cabinets will look nice and neat when the shelves are rotated.

A further object is to be able to have easy access to the canister thereof. Another object is to provide a canister for food to keep out insects and humidity, so that it will stay fresh longer.

The foregoing objects can be accomplished by providing a canister that conforms to the circular shelves of kitchen corner cabinets that have center objects. Said canister has the width near the front wider than the opposing end with the two sides of equal length.

DESCRIPTION OF THE PREFERRED EMBODIMENTS

Figure 1:
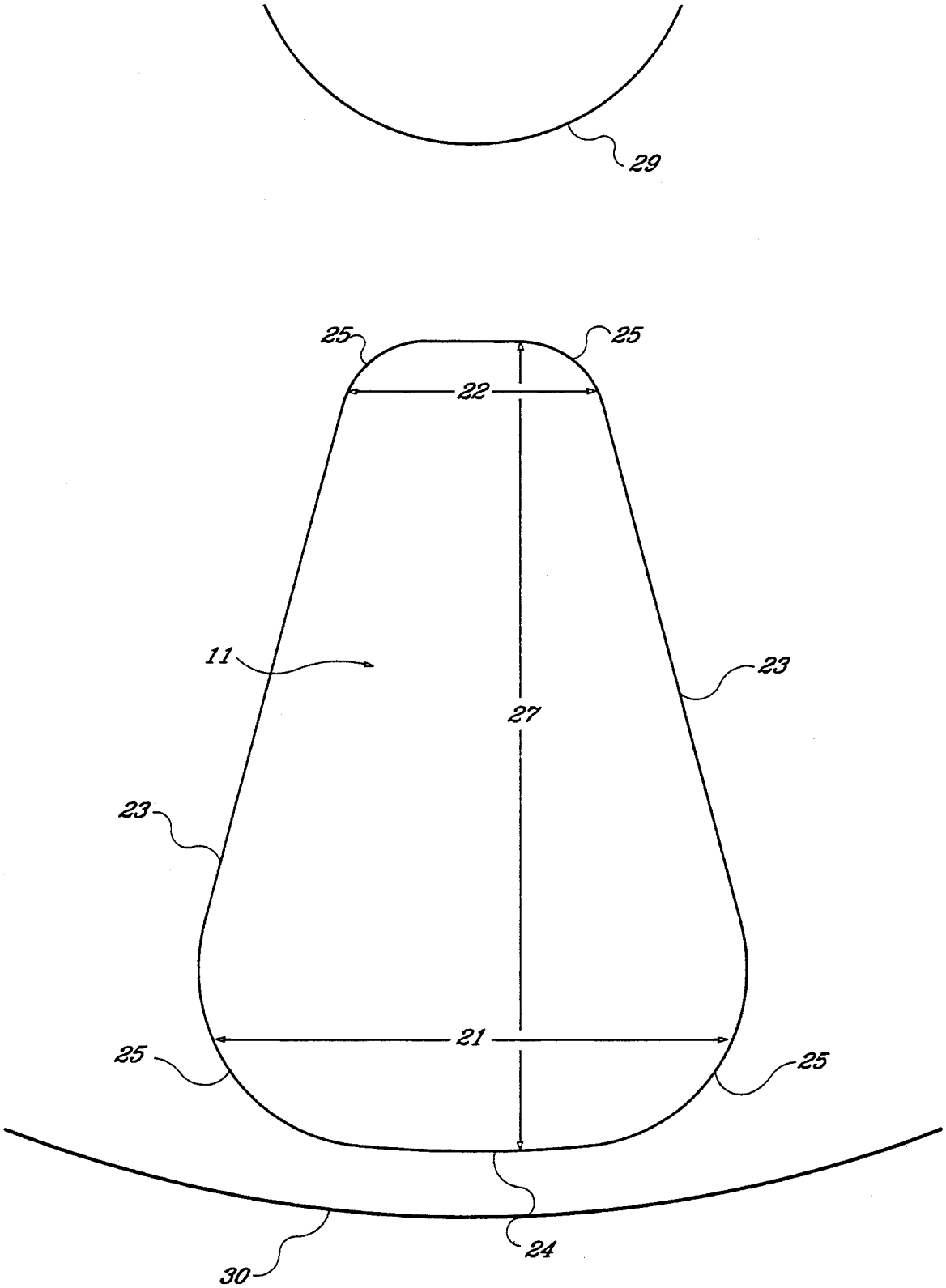
FIG. 1 is a bottom view of a canister.
Figure 2:
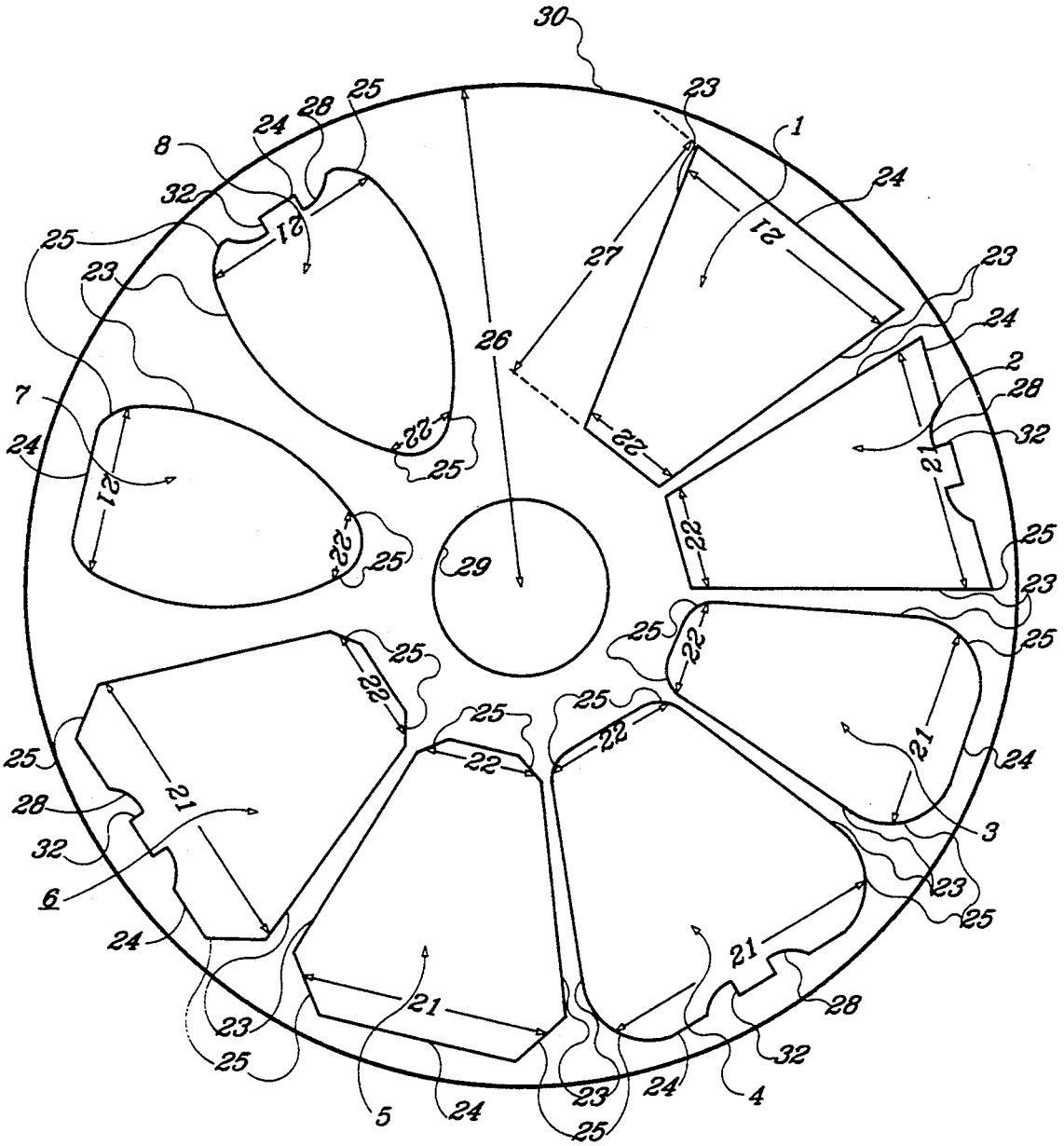
FIG. 2 is a smaller bottom view of canisters of various, shapes seated on a circular shelf of a kitchen corner cabinet.
Figure 3:
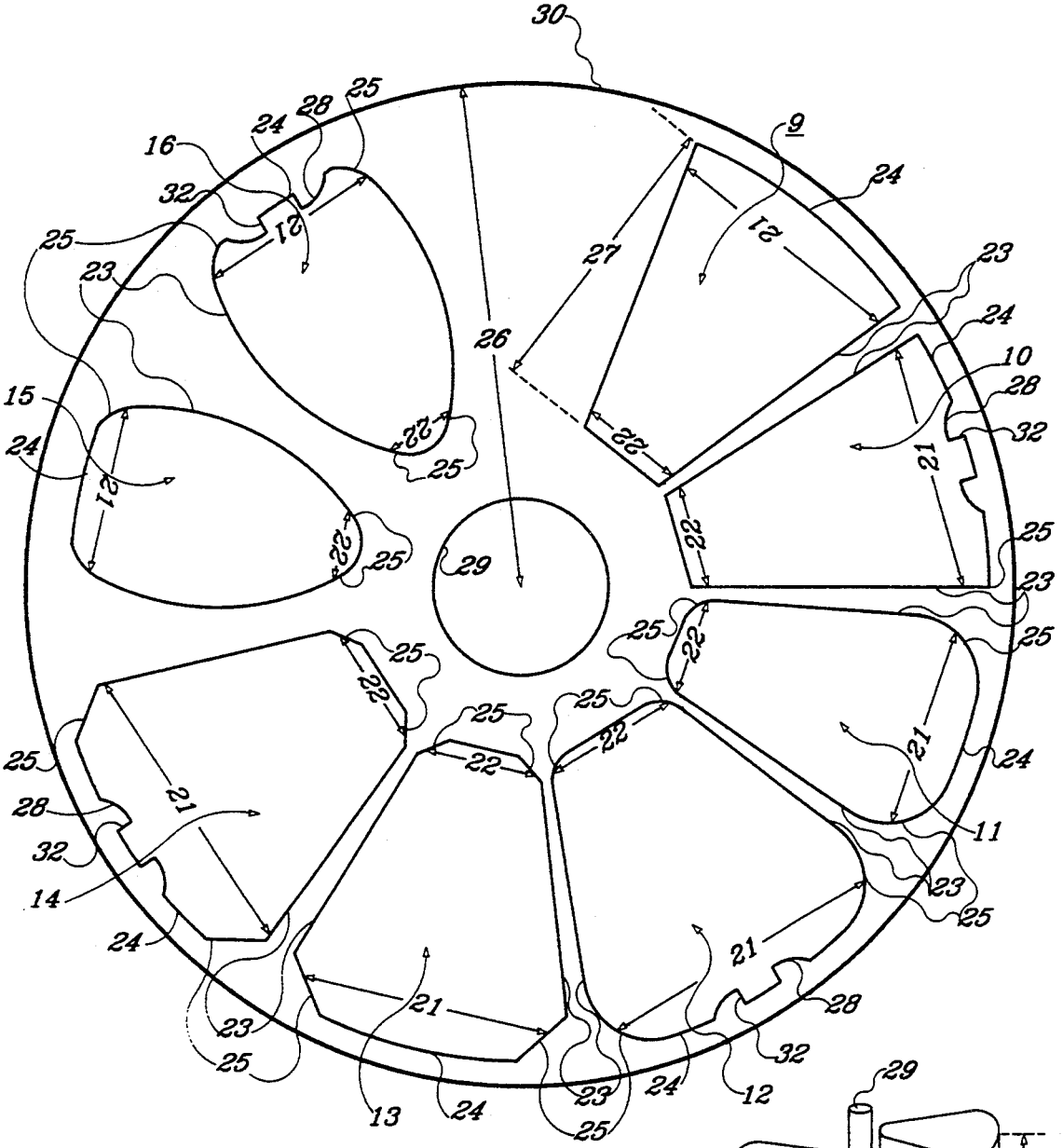
FIG. 3 is a small bottom view of canisters shaped like FIG. 2 with a slight variation.
Figure 4:
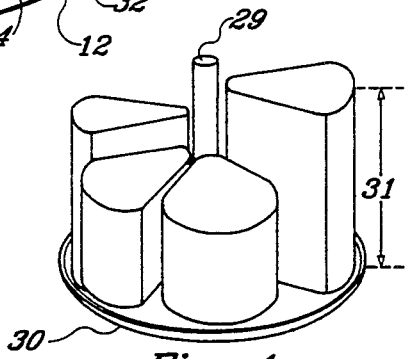
FIG. 4 is a perspective view of canisters of different volumes.
Figure 5:
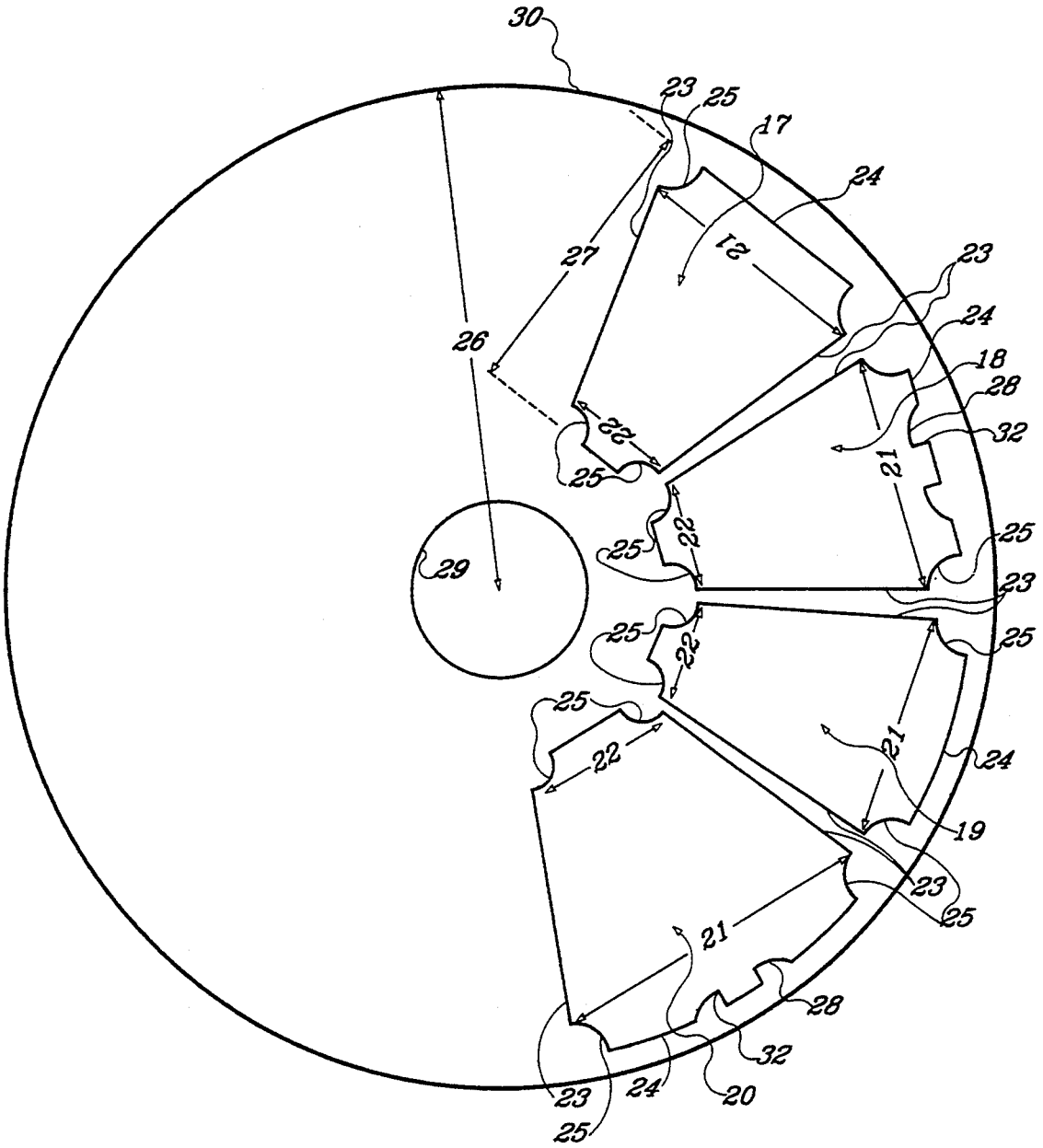
FIG. 5 is a small bottom view of canisters of other various shapes seated on a circular shelf of a kitchen corner cabinet.

Refer now to FIG. 1 and FIG. 4 which is the preferred embodiment of the invention. This canister has the width 21 near the front 24 being wider than the back 22 which allows space for the center post, brackets and/or raised places that are in kitchen corner cabinets that have circular rotating shelves.

FIG. 1 also shows the front 24 bowing slightly outward and the corners 25 being rounding.

The depth 27 of all canisters from front to back are determined in part by the radius 26 of the shelves 30 for which they are made and in part by the size of the center object 29 and the like, and with the widths 21 & 22 and height 31 determining the volume of the canisters as in FIG. 4. Each said canister has a base joining upstanding side walls perpendicular to the base. The side walls are joined as one at the corners. They each have a substantially closing lid member on the top. They can be seated around the edge of the circular shelves in the cabinet along beside others of similar shape to utilize more space in the cabinet.

Said canisters being made of suitable materials such as plastic are to hold flour, sugar, cereal, grain and the like and to keep insects and humidity out of the canister.

Alternate versions of Canisters 1–8 and 17–18 are shown with the widths 21 at the fronts 24 being wider than the backs 22 and with the sides 23 of equal length. Canisters 3, 4, 7 and 8 are shown with rounding corners 25; canisters 5 and 6 are shown with two angles at each corner 25; canisters 17 and 18 are shown with the corners 25 curving inward which also makes two angles at each corner 25; canisters 7 and 8 are shown with the sides 23 bowing slightly outward; and canisters 2, 4, 6, 8, and 18 are shown with two dips 28 in the fronts 24 as a means for handles 32.

Referring now to canisters 9–16 and 19–20, these canisters are shown with the widths 21 near the fronts being wider than the backs 22 with the sides 23 of equal length and with the fronts 24 bowing slightly outward to conform to the similarity of the circumference of the shelves. Canisters 11, 12, 15 and 16 are shown with rounding corners 25; canisters 13 and 14 are shown with two angles at each corner 25; canisters 19 and 20 are shown with the corners curved inward which also makes two angles at each corner 25; canisters 15 and 16 are shown with the two sides 23 bowing slightly outward; and canisters 10, 12, 14, 16 and 20 are shown with two dips 28 in the fronts as a means for handles 32.

Canister 1 has an isosceles trapezoid shaped base with four upstanding side walls. Canisters 2–6, 9–14 and 17–20 have substantially isosceles trapezoid shaped bases.

Canister 15 has an egg-shaped base and canisters 7–8 and 16 have substantially egg-shaped bases. Canisters 7, 8 and 16 could also be called substantially isosceles trapezoidal. These shapes are to allow a space for the center post, bracket and/or raised places.

It is believed that this invention will help to utilize more of the space on the circular rotating shelves and in the kitchen corner cabinets where there is a center post, bracket and/or raised places, to have uniformity and neatness in the cabinet on the shelves when the shelves are rotated and to make the canisters more easily accessible from the cabinet.

The foregoing description of the preferred embodiment of the invention has been presented for the purposes of illustration and description. It is not intended to be exhaustive or to limit the invention to the precise form disclosed. Many modifications and variations are possible in the light of the above teaching. It is intended that the scope of the invention be limited not by this detailed description but rather by the claims appended hereto.

What is claimed is:

1. In combination with a circular support base, at least one canister having means which provides a seating around the edge of said circular support base and allows space for any object located centrally of said base, said canister comprising;

an isosceles trapezoid shaped base having a front, a back and two sides, with the width at the front being wider than the back, said canister base joining with upstanding side walls perpendicular to the base, with the side walls joining each other and forming corners, said canister having a substantially closing lid member, and the depth of said at least one canister, from front to back, being determined in part, by the radius of said support base and, in part, by any centrally located object on said support base, the width and height of said at least one canister determining the volume thereof, said at least one canister being made of suitable material, such as plastic, so as to keep insects and humidity out of said canister, and wherein said circular support base is a circular rotating shelf of a kitchen corner cabinet, said shelf having a centrally located object thereon.

2. Canister of claim 1 further comprising two dips in the front as a means for a handle.

3. Canister of claim 1 further comprising rounding corners as a means of connecting the sides to the back and front.

4. Canister of claim 1 further comprising rounding corners as a means of connecting the sides to the back and front, and with two dips in the front as a means for a handle.

5. Canister of claim 1 further comprising an angled face at each corner as a means to join the sides to the back and front.

6. Canister of claim 1 further comprising an angled face at each corner as a means to join the sides to the back and front, and with two dips in the front as a means for a handle.

7. Canister of claim 1 further comprising the fronts bowing slightly outward as a means to conform to the similarity of the circular shelves.

8. Canister of claim 1 further comprising the front bowing slightly outward as a means to conform to the similarity of the circular shelves, and with two dips in said front as a means for a handle.

9. Canister of claim 1 further comprising the front bowing slightly outward as a means to conform to the similarity of the circular shelves, and with rounding corners as a means to join the front and the back with the sides.

10. Canister of claim 1 further comprising the front bowing slightly outward as a means to conform to the similarity of the circular shelves, with rounding corners as a means to join the front and back to the sides, and with two dips in said front as a means for a handle.

11. Canister of claim 1 further comprising the front bowing slightly outward as a means to conform to the similarity of the circular shelves, and with an angled face at each corner as a means for uniting the sides with the back and the front.

12. Canister of claim 1 further comprising the front bowing slightly outward as a means to conform to the similarity of the circular shelves, with an angled face at each corner as a means for uniting the sides with the front and the back, and with two dips in said front as a means for a handle.

13. A canister means comformable to the circular shelves of kitchen corner cabinets so as to utilize more of the space in the cabinets and thereby provide uniformity and neatness on said shelves and being more easily accessible, said canister means comprising, an egg-shaped base joining upstanding side walls as a means for forming an empty container and having a substantially closing lid member, the depth of said canister means, from front to back, being determined, in part, by the radius on said shelf, and the size of any centrally located object on said shelf, and with the width and height of said canister means for determining the volume of the canister.

14. Canister of claim 13 further comprising two dips in the front as a means for a handle.

15. Canister of claim 13 further comprising the front having a flat surface as a means for having a different front.

16. Canister of claim 13 further comprising the front having a flat surface as a means for having a different front, and with two dips in said front as a means for a handle.

17. A canister means comformable to the circular shelves of kitchen corner cabinets so as to utilize more of the space in the cabinets to thereby provide uniformity and neatness on the shelves thereof, and being more easily accessible, said canister means comprising, a base having a front, a back and two sides with the width at the front being wider than the back, said front and back being joined by the two sides of equal length, said base joining with upstanding side walls perpendicular to the said base, with said side walls joining with each other and forming corners, said corners curving inward and having a substantially closing lid member, the depth of said canister means, from front to back, being determined, in part, by the radius of said shelf and the size of any centrally located object on said shelf, and with the width and height of said canister means for determining the volume of the canister.

18. Canister of claim 17 further comprising two dips in the front as a means for a handle.

19. Canister of claim 17 further comprising the front bowing slightly outward as a means to conform to the similarity of the circular shelves.

20. Canister of claim 17 further comprising the front bowing slightly outward as a means to conform to the similarity of the circular shelves and with two dips in said front as a means for a handle.

* * * * *